US006027366A

United States Patent [19]

Mori et al.

[11] Patent Number: 6,027,366

[45] Date of Patent: Feb. 22, 2000

[54] FLAT CABLE, CONNECTION DEVICE THEREFOR AND ELECTRIC CIRCUIT APPARATUS

[75] Inventors: Hideo Mori; Toshimichi Ouchi, both of Yokohama; Kazuhiko Murayama, Atsugi, all of Japan

[73] Assignee: Canon Kabushiki Kaisha, Tokyo, Japan

[21] Appl. No.: 09/017,928

[22] Filed: Feb. 3, 1998

Related U.S. Application Data

[63] Continuation of application No. 08/395,468, Feb. 28, 1995, abandoned.

[30] Foreign Application Priority Data

Feb. 28, 1994 [JP] Japan ..... 6-029507
Jun. 30, 1994 [JP] Japan ..... 6-048867

[51] Int. Cl.[7] ..... H01R 9/07

[52] U.S. Cl. ..... 439/495; 439/67

[58] Field of Search ..... 439/67, 77, 492–499; 174/117 F, 117 FF

[56] References Cited

U.S. PATENT DOCUMENTS

| | | | |
|---|---|---|---|
| 3,007,131 | 10/1961 | Dahlgren et al. | 439/492 |
| 4,184,729 | 1/1980 | Parks et al. | 339/17 F |
| 4,302,065 | 11/1981 | Taylor | 339/17 F |
| 4,357,065 | 11/1982 | Kam et al. | 339/97 R |
| 4,381,420 | 4/1983 | Elliot et al. | 174/34 |
| 4,684,183 | 8/1987 | Kinoshita et al. | 439/77 |
| 4,936,792 | 6/1990 | Onoue et al. | 439/495 |
| 5,360,943 | 11/1994 | Mori et al. | 174/84 R |
| 5,385,478 | 1/1995 | Niekawa | 439/495 |
| 5,391,089 | 2/1995 | Quickel et al. | 439/637 |
| 5,414,220 | 5/1995 | Hanato et al. | 439/67 |

FOREIGN PATENT DOCUMENTS

| | | |
|---|---|---|
| 58-179825 | 10/1983 | Japan . |
| 3-176971 | 7/1991 | Japan . |
| 4-371921 | 12/1992 | Japan . |
| 5-36454 | 2/1993 | Japan . |
| 6-177497 | 6/1994 | Japan . |
| 6-188533 | 7/1994 | Japan . |

*Primary Examiner*—Paula Bradley
*Assistant Examiner*—Tho D. Ta
*Attorney, Agent, or Firm*—Fitzpatrick, Cella, Harper & Scinto

[57] ABSTRACT

A flat cable is formed by disposing a layer of conductor lines on one side and a conductor layer on the other side, respectively, of an insulating support layer so as to provide a connection part having a laminated structure including the conductor lines, the insulating support layer and the conductor layer in this order. The flat cable is connected with a connector including a housing and contacts disposed to be connected with the conductor lines and the conductor layer on mutually opposite inner surfaces of the housing. The resultant connection structure effectively utilizes both surfaces of the flat cable to be reduced in size and allows a stable connection and a stable potential level of the conductor and conductor lines.

8 Claims, 11 Drawing Sheets

FIG. 9A
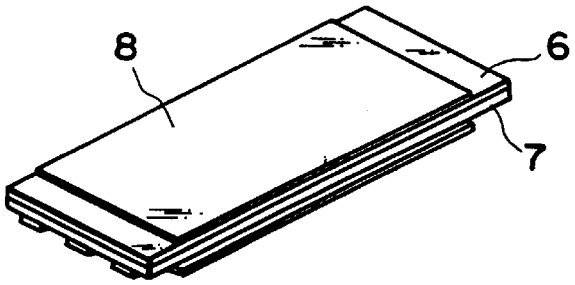
FIG. 9B
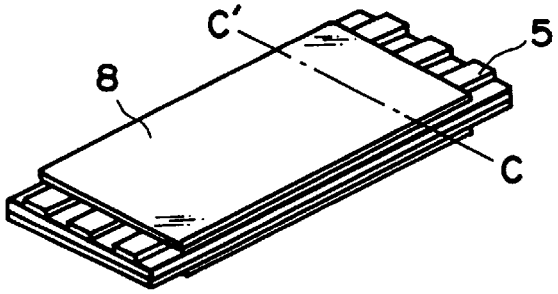
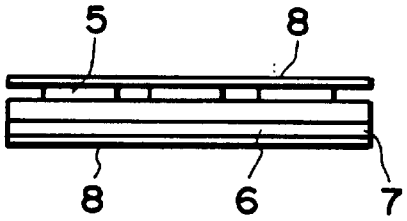
FIG. 10
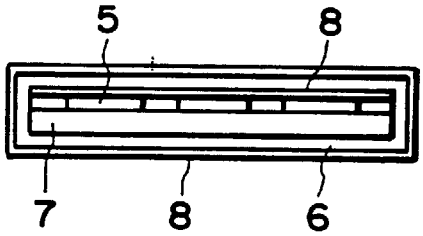
FIG. 11
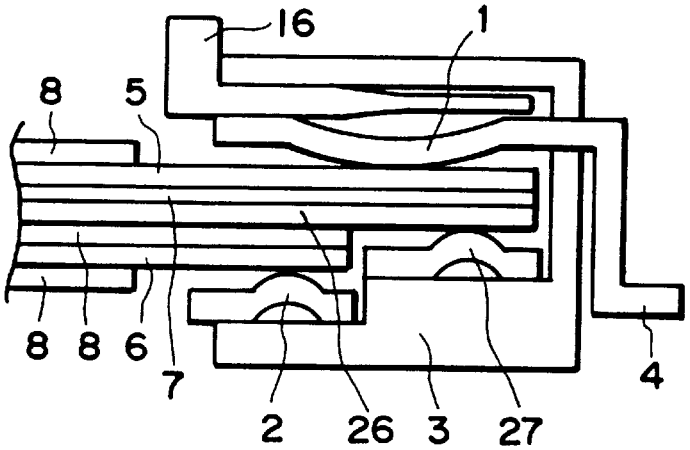
FIG. 12

FIG. 13A
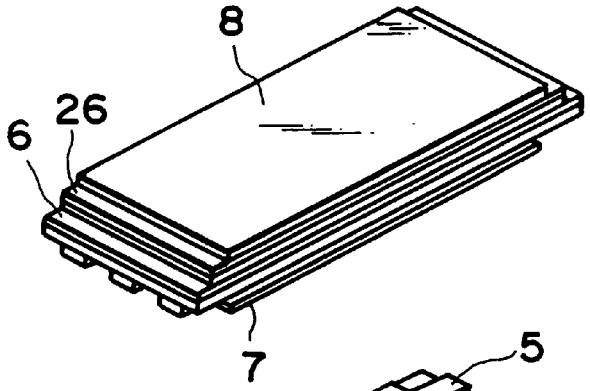
FIG. 13B
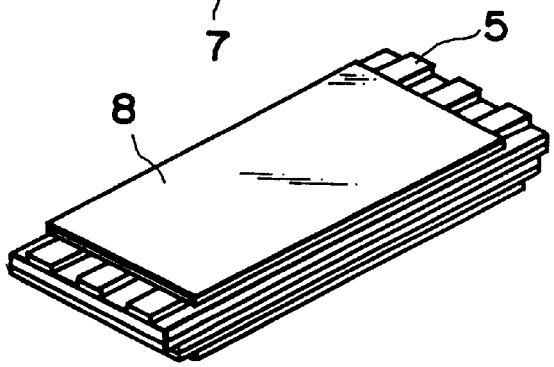
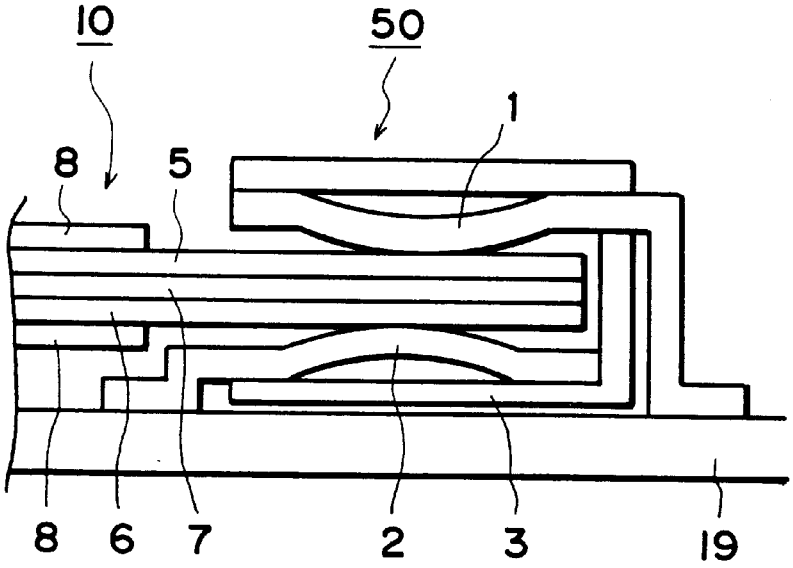
FIG. 14

FLAT CABLE, CONNECTION DEVICE THEREFOR AND ELECTRIC CIRCUIT APPARATUS

This application is a continuation of application Ser. No. 08/395,468, filed on Feb. 2, 1995, now abandoned.

FIELD OF THE INVENTION AND RELATED ART

The present invention relates to a flat cable suitably used in electric circuit apparatus, such as a flat panel display, a contact-type image sensor, a light-emission device array, a thermal head and an ink jet recording head, a connection device for such a flat cable, and also such an electric circuit apparatus including them.

Hitherto, there have been used so-called flat cables, inclusive of flexible print-circuits and flexible flat cables (FPC and FFC) as means for supplying signals and power voltages to peripheral driver boards in a flat panel display, such as a liquid crystal display apparatus.

The connection with a flat cable involves problems that the impedance of the cable is liable to cause a fluctuation in reference potential (GND) and accordingly supply noises in the signals, thereby causing a malfunction of the integrated circuit, and radiation noises are liable to be generated. In order to solve the problem, it has been adopted to use a grounding wire having plural core conductors for stabilizing the GND potential. Separately, it has been known as a measure for preventing radiation noises to form a shield layer of copper foil or aluminum foil wrapped about the flat cable and electrically connecting the shield layer to a wire in the flat cable for grounding by a through-hole, welding or crimping.

FIGS. 24A–24C are views for illustrating a conventional flexible print-circuit sheet (as a flat cable) and a connection device therefor, including FIG. 24A showing an outer appearance of the flexible print-circuit sheet, FIG. 24B showing a section thereof, and FIG. 24C showing a section of the connection device in association with the flexible print-circuit sheet.

Referring to FIGS. 24A–24C, a flexible print-circuit sheet 10 includes a signal conductor lines 5, an insulating support sheet (film) 7, a shield conductor layer 6 and a protective layer 8. The shield conductor layer 6 is connected with one (5') of the conductor lines 5 via a through-hole SH of a small section area.

A connector (connection device) 50 has contacts 1 within a housing 3 and is disposed on a print-circuit board 19 so that the contacts 1 contact the conductor lines 5 respectively of the print-circuit sheet 10.

In the connection state, the shield conductor layer 6 of the print-circuit sheet 10 is not present in the housing 3 but is connected to the GND potential as a reference potential via the through-hole SH and one (5') of the conductor lines 5.

In the structure of the conventional flat cable shown in FIGS. 24A–24C, however, the connecting portion thereof with the contact is disposed on only one side thereof (the side of the signal conductor lines), and one conductor line 5' for connection with the shield layer 6 is consequently arranged in parallel with the other signal conductor lines 5 so that the flat cable is caused to have a larger entire width.

In case of the connection with a flat cable having the above structure, the conductor lines are disposed laterally in a single layer and are caused to have a further increased width as the quantity of data conveyed therethrough is increased. A larger width of flat cable not only occupies a larger space in the entire apparatus but also requires a larger width of connector for connection between the flat cable and the print-circuit board.

Further, in the above-mentioned conventional flexible print-circuit sheet as a flat cable, the electrical connection between the shielding conductor and the ground potential is effected only through a small through-hole SH, so that there remains a liability of potential fluctuation or occurrence of noises. Particularly, in the case where conductor lines are arranged transversely, a signal line remote from a grounding line is liable to be electrically unstable, e.g., when the grounding line is disposed at an utmost side, thereby causing a malfunction of the apparatus or generating radiation noises affecting surrounding apparatus.

Further, the step of forming the through-hole has invited an increased production cost of the print-circuit sheet.

The above-mentioned difficulties have become further serious as the conductor lines are arranged at a higher density, i.e., a smaller pitch.

SUMMARY OF THE INVENTION

A principal object of the present invention is to provide a flat cable having solved the above-mentioned problems and allowing a less expensive and higher-density loading or arrangement, and a conductor device therefor.

Another object of the present invention is to provide a flat cable and a conductor device therefor capable of preventing adverse noise effects and fluctuation of the reference potential.

A further object of the present invention is to provide an electric circuit apparatus including a flat cable and a connection device therefor as described above.

According to the present invention, there is provided a flat cable, comprising: an insulating support layer, a first layer of conductor or conductor lines disposed on one side of the support layer and a second layer of conductor or conductor lines disposed on the other side of the support layer, wherein the flat cable includes a connection part to be connected with a connection device, said connection part having a laminated structure including said first layer of conductor or conductor lines, the insulating support layer and said second layer of conductor or conductor lines.

According to another aspect of the present invention, there is provided a connection device for connection with a flat cable having a layer of conductor or conductor lines on each of both sides of an insulating support layer, comprising: a housing for insertion thereinto of the flat cable having mutually opposite inner surfaces, and contacts respectively disposed on the opposite inner surfaces of the housing for connection with the layers of conductor or conductor lines on both surfaces of the flat cable.

According to still another aspect of the present invention, there is provided an electric circuit apparatus, comprising: a flat cable comprising an insulating support layer and layers of a conductor or conductor lines formed on both sides, respectively, of the insulating support layer, and a connection device for connection with the flat cable; wherein said flat cable includes a connection part having a laminated structure including said insulating support layer and said layers of conductor or conductor lines disposed on both sides of the insulating support layer; and said connection device comprises a housing for insertion thereinto of the flat cable having mutually opposite inner surfaces, and contacts respectively disposed on the opposite inner surfaces of the housing; said connection device being connected with the flat cable so that each contact thereof corresponds to one of the conductor or conductor lines of the flat cable.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 9A and 9B are a perspective view as viewed from the GND side and a perspective as viewed from the signal line side, respectively of another embodiment of the flat cable according to the invention.

FIG. 10 is a sectional view of the flat cable taken along a C–C' line in FIG. 9B.

FIG. 11 is a sectional view of another embodiment of the flat cable according to the invention.

FIG. 12 is a sectional view of another embodiment of the connector according to the invention in combination with a flat cable.

FIGS. 13A and 13B are perspective views of another embodiment of the flat cable according to the invention.

FIG. 14 is a sectional view of another embodiment of the connector according to the invention.

DESCRIPTION OF THE PREFERRED EMBODIMENTS

Figure 1:
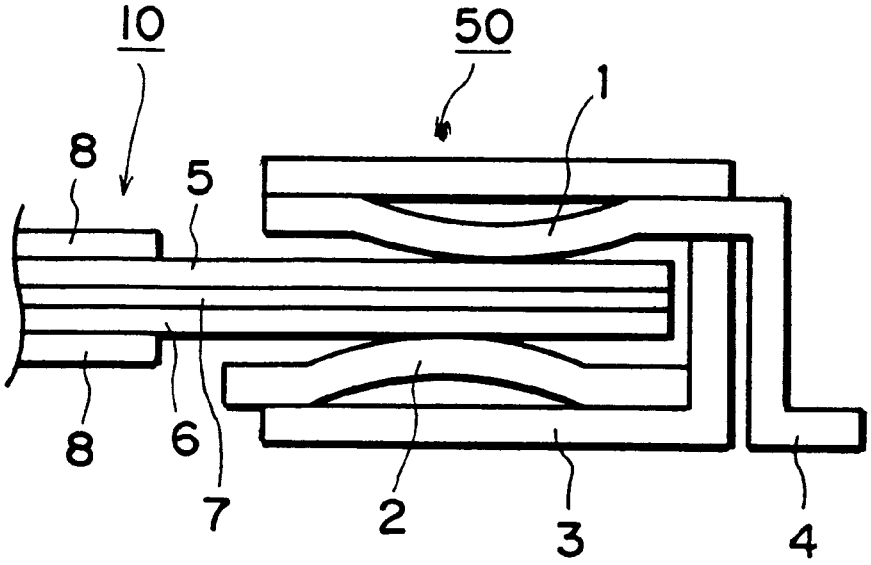
FIG. 1 is a sectional view of an embodiment each of the flat cable (flexible print-circuit sheet) and the connection device according to the invention in a mutually connected state.

The term "flat cable" is used herein in a sense of including, e.g., a flexible print-circuit sheet (FPC) and a flexible flat cable (FFC). More specifically, a flexible print-circuit sheet may be represented by a structure including an insulating flexible support layer (or sheet) and a layer of conductor or conductor lines formed in a prescribed pattern, e.g., by printing, photolithography, etc., and optionally coated with a protective layer on at least one of two major surfaces of the support layer. Further, a flexible flat cable may be represented by an integrally laminated structure including a flexible insulating support layer (or sheet) and a layer of conductor or conductors disposed and optionally coated with a protective layer on at least one of two major surfaces of the support layer.

In the flat cable (typically, flexible print-circuit sheet) according to the present invention, the part of connection thereof with a connector (connection device) is caused to have a laminated structure including an insulating support layer or sheet and at least two layers including a conductor layer and/or a layer of conductor lines, i.e., so as provide both surfaces of the flat cable with a function of connection with the connector, thereby preventing an increase in entire width of the print-circuit sheet and allowing a higher density arrangement. Particularly, it has become unnecessary to connect a shield conductor layer via a small through-hole provided in the support layer, thereby preventing. a potential fluctuation and adverse noise effects.

If the conductor layer (shield conductor) is made in a larger width, the fluctuation in reference potential is minimized, and the structure of the connection part can be simplified.

Further, by disposing the conductor layer (shield conductor) so as to surround the respective conductor lines (signal lines), the effect of the shield conductor layer is enhanced.

On the other hand, in the connection device, the inner upper surface and the inner lower surface of a housing thereof into which the flat cable is inserted, are respectively caused to have a contact for connection with the conductor layer or the conductor lines constituting the laminated structure of the flat cable, thereby facilitating a higher density loading. Further, by disposing the contact for the shield conductor layer in a direction different from the direction of the conductor lines (signal lines), a larger area connector loading is facilitated.

In the connection device according to the present invention, it is preferred that the housing is provided with contacts on upper and lower inner surfaces thereof for connection with the conductor layer or conductor lines of the flat cable so that one (preferably on the upper inner surface) is formed of a member (preferably of a metal) extending in a direction opposite to the side of insertion of the flat cable to be fixed by soldering to a supporting substrate and the other contact (preferably on the lower inner surface) is formed of a member extending in a direction toward the side of insertion of the flat cable to be fixed by soldered onto a supporting substrate, whereby a loading at a high density which is two or more times that in the conventional case becomes possible.

In the present invention, if one of two layers of the conductor layer and/or the conductor lines formed on both sides of the flat cable is uniformly brought to a reference potential, a fluctuation of the reference potential can be prevented to provide a stable reference potential. Further, by decreasing the physical distance between the signal lines and the reference potential, the fluctuation in signal line potential can also be suppressed, to prevent a malfunction thereof and suppress radiation noises. Further, if the conductor lines on the reference potential side are made as a single layer extending over the side and the contact is provided in a width substantially equal to the width of the flat cable, the reference potential-stabilizing effect is further enhanced.

Thus, according to the present invention, the reliability of an electric circuit apparatus can be improved without inviting a substantial increase in production cost.

FIG. 1 is a sectional view showing a manner of connection of an embodiment each of the flat cable (flexible print-circuit sheet) and the connection device (connector) according to the present invention.

Referring to FIG. 1, a flexible print-circuit sheet 10 includes a shield conductor layer 6 and a signal conductor layer (preferably connection devices) 5 formed on both surfaces of an insulating support sheet 7 and optionally coated with insulating protective layers 8.

A connector 50 (as an embodiment of the connection device according to the present invention) includes a housing in the form of a (laterally fallen) U-shaped mold 3 and contacts 1 and 2 disposed therein on the upper side and lower side, respectively, so that the contact 1 contacts the signal conductor layer (conductor lines or conductor pattern) 5 and the contact 2 contacts the shield conductor layer 6. The contacts 1 and 2 are respectively composed of an inwardly convex electroconductive member so as to sandwich the upper and lower surfaces of the connection part of the print-circuit sheet 10. The electroconductive member providing the contact 1 is optionally extended to provide a contact 4 to be soldered.

Figure 2:
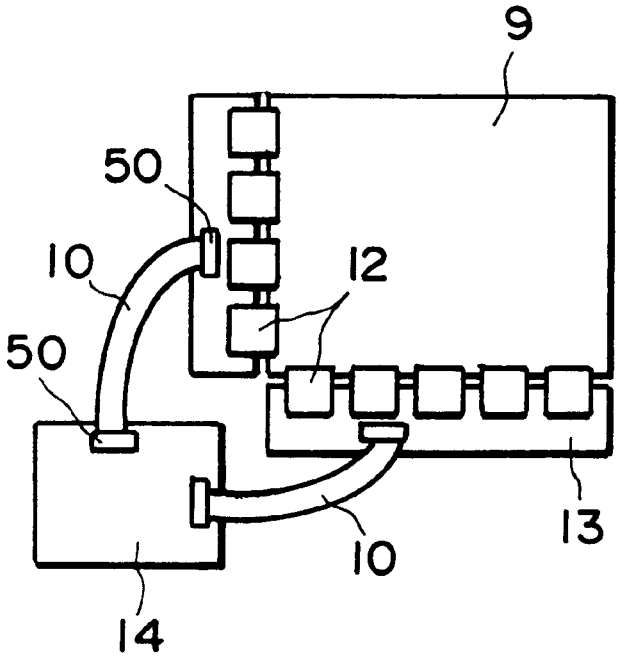
FIG. 2 is a schematic view showing an arrangement of an embodiment of the electric circuit apparatus according to the invention.

FIG. 2 is a plan view showing schematically a liquid crystal display apparatus as an embodiment of the electric circuit apparatus.

The liquid crystal display apparatus includes a liquid crystal panel 9 as a display means, driver ICs 12 connected to matrix electrodes of the liquid crystal panel 9 as a driver circuit for supplying drive signals, bus substrates 13 connected to the driver ICs 12 and including signal lines and bus lines for supplying respective signals and a reference voltage to the driver ICs, and a control circuit board 14 loaded with a CPU, etc.

The liquid crystal apparatus further includes flat cables 10 as described above connected to the bus substrates 13 and the control circuit board 14 with connectors 50 as described above.

As the display means (panel) is enlarged in area, the flat cable 10 is also required to be size-enlarged and have a higher density arrangement. However, if the flat cable 10 and the connector 50 according to the present invention are used, the requirements in accordance with the size-enlargement of the panel are satisfied without adverse influences, such as noises or fluctuation in reference voltage.

Hereinbelow, the respective members used in the present invention will be described in detail with reference to drawings wherein like parts are denoted by like reference numerals.

The flat cable according to the present invention is characterized by having a connection part having a laminated structure including an insulating support sheet and at least two conductive layers (conductor layer and layer of conductor lines). Some embodiments of modification will be described with reference to FIGS. 3A–3E each including a transverse sectional view and a longitudinal sectional view.

Figures 3A, 3B, 3C, 3D, 3E:
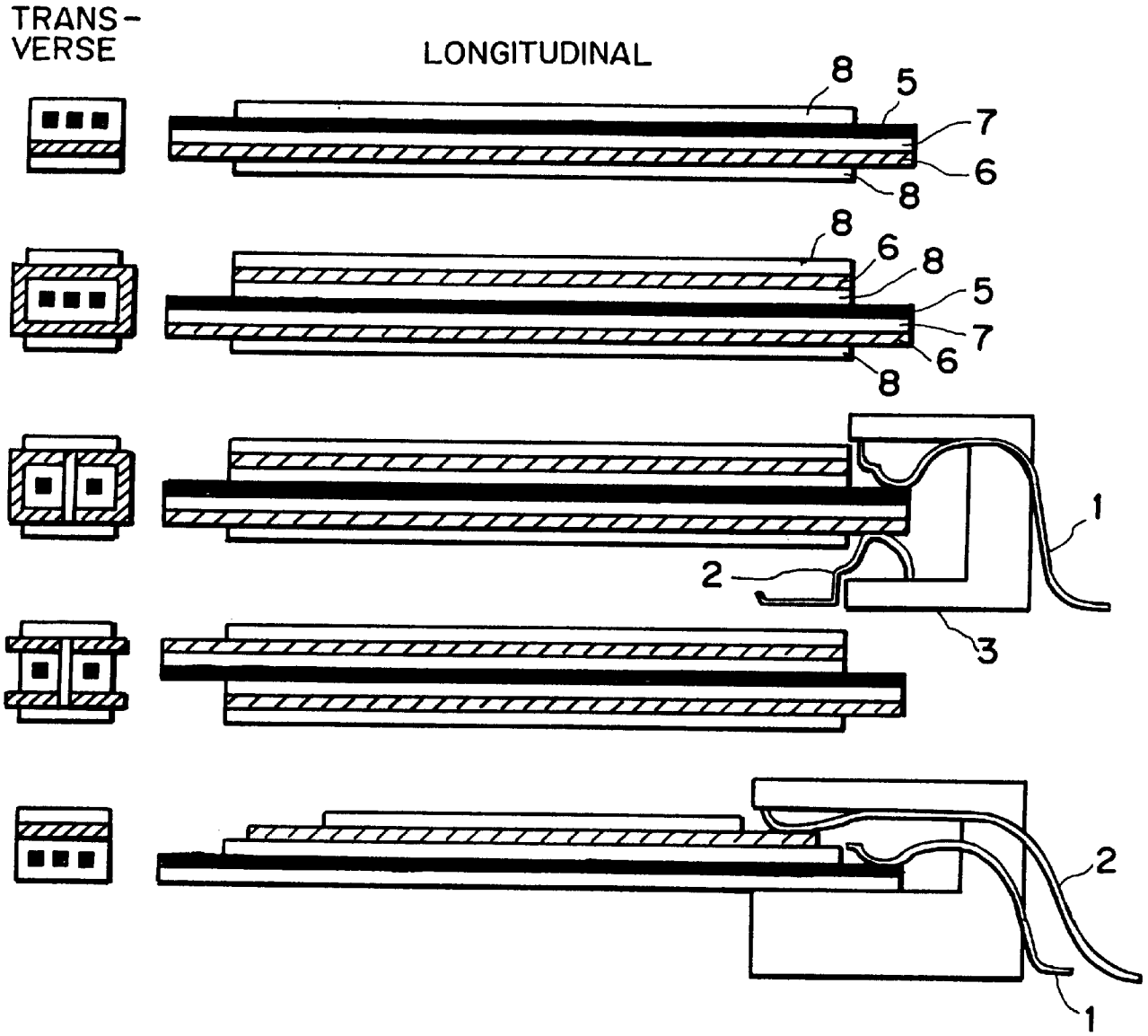
FIGS. 3A to 3E each show a transverse section and a longitudinal section of an embodiment of the flat cable according to the invention.

FIG. 3A shows a print-circuit sheet having a connection part of a laminated structure including one shield conductor layer 6 and one layer of signal conductor lines 5, and having optional insulating protective layers 8.

FIG. 3B shows a print-circuit sheet including two shield conductor layers 6 above and below a layer of signal conductor lines 5 and two shield conductor layers disposed also on both lateral sides so as to surround the signal line layer 5, thereby enhancing the shielding effect. The connection part is of the same laminated structure as in FIG. 3A.

FIG. 3C shows a modification of the embodiment of FIG. 3B, wherein at least one of the signal conductor lines 5 is short-circuited with the upper and lower shield conductor layers 6. This structure is suitable for obviating crosstalk between signal lines. FIG. 3C also shows a state of connection of the print-circuit sheet with a connector having a pair of upper and lower contacts 1 and 2 having mutually opposing projections disposed within a housing 3.

FIG. 3D shows a modification of FIG. 3C, wherein the shield conductor layer 6 is removed from both lateral sides, and the lamination order of the layers 5 and 6 is reversed at the connection parts on both ends.

FIG. 3E is a modification of FIG. 3A, wherein the shield conductor layer 6 and the layer 5 of conductor lines both have exposed upper surfaces and respectively contacting two contacts having different vertical and lateral positions.

The conductive layer constituting a conductor line 5 or a conductor layer 6 used in the flat cable according to the present invention may preferably comprise a layer of a metal, such as Al, Cu, Ni, Pt, Au or Ag. The insulating support sheet 7 and the protective layer 8 may preferably comprise a flexible film or layer of a polymer, such as polyester, polyamide or polyimide.

Each sheet or layer may have a thickness appropriately selected from the range of 10 $\mu$m to 50 $\mu$m.

The conductive lines 5 may preferably be arranged at a pitch of at most 3 mm, more preferably at most 1 mm, so as to better exhibit the effect of the present invention.

Figure 4:
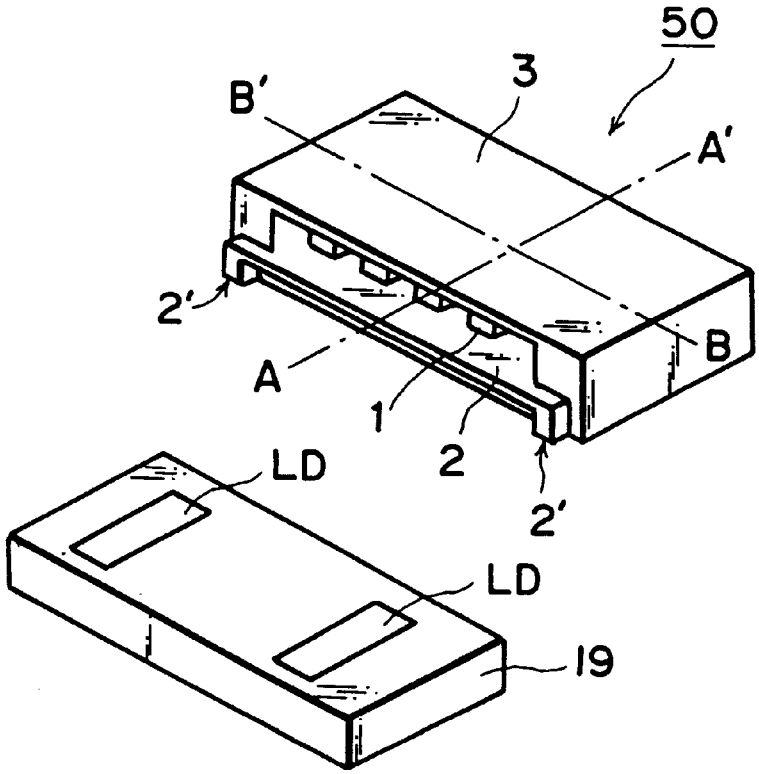
FIG. 4 is an exploded perspective view of an embodiment of the connection device (connector) according to the invention.

FIG. 4 is an exploded perspective view of an embodiment of the connector (connection device) according to the present invention, wherein, of upper and lower contacts 1 and 2 in a housing 3, the lower contact 2 is provided with a uniform contacting surface over the entire width within the housing 3 for connection with a shield conductor layer for grounding. The contact 2 is integrally provided with terminals 2' for fixation, and the connector 50 is mounted on a board 19 by bonding the terminals 2' to solder lands LD for grounding.

The housing 3 of the connector 50 and optional insulators therein may preferably comprise, e.g., polyamide, mesomorphic polymer or polyphenylene sulfide. The height of the housing 3 may preferably be suppressed to at most 2.0 mm.

Figure 5:
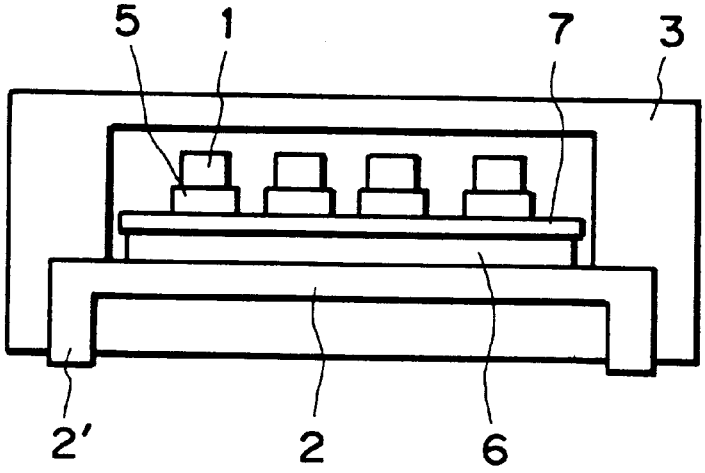
FIG. 5 is a sectional view taken along a B–B' line in FIG. 4.

A structure formed by inserting a flat cable 10 as described above into the connector 50 shown in FIG. 4 may be represented by FIG. 1 as a sectional view taken along an A–A' line in FIG. 4 and by FIG. 5 as a sectional view taken along a B–B' line in FIG. 4.

Figure 6:
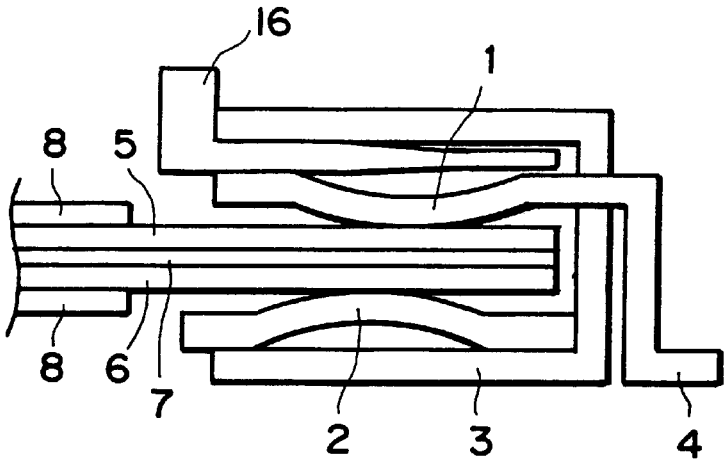
FIGS. 6–8 are respectively a sectional view of another embodiment of the connector according to the invention.

FIG. 6 is a sectional view showing a state of connection between a flexible print-circuit sheet and another connector according to the present invention. In this embodiment, a fixing plate 16 called a retainer is inserted into the housing 3 so as to provide a more reliable contact between the connector contacts 1, 2 and contact points of the conductive layers 5, 6 in the flat cable. This is also effective for ensuring a clearance for inserting the flat cable to facilitate the insertion.

Figure 7:
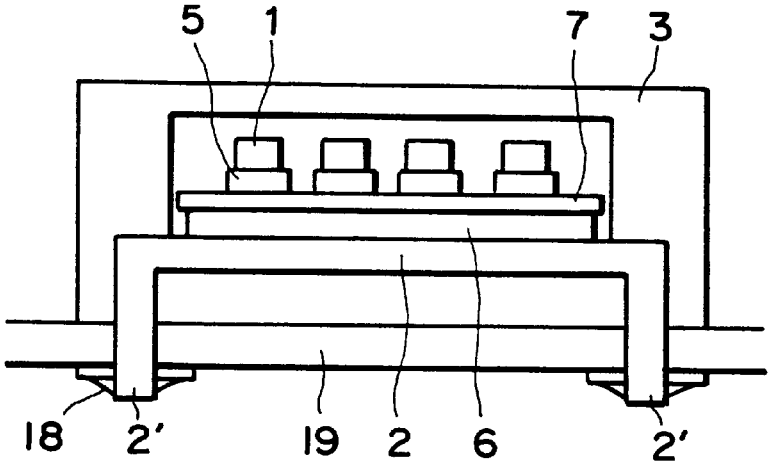

FIG. 7 is a transversal sectional view showing another embodiment of the connector. Members 2' integrally extended from a contact 2 for grounding are further extended to piece through a print-circuit board 19 to be mechanically and electrically connected with a solder 18 on the opposite surface of the print-circuit board 19.

Figure 8:
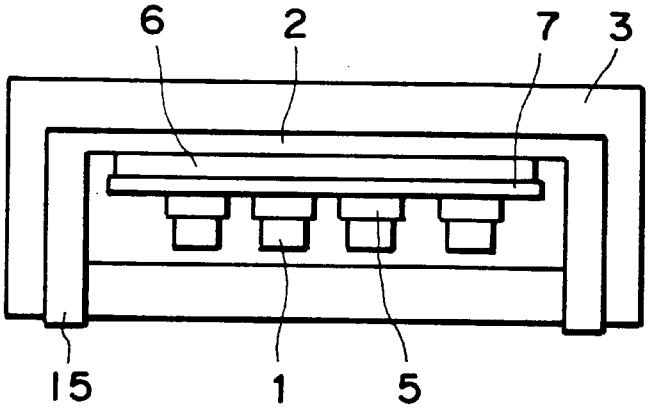

FIG. 8 is a sectional view of another embodiment of the connector for connection with a flat cable having signal lines 5 on the lower side and a shield layer 6 to be grounded on the upper side. The connector includes a contact 2 for grounding composed of a metal sheet 15, which also functions as a shielding plate.

FIGS. 9A and 9B are perspective views of another embodiment of the flat cable (print-circuit sheet) having a structure similar to the one shown in FIG. 3A as viewed from its grounding side and signal side, respectively. The print-circuit sheet includes signal lines 5 on one side and a shielding and grounding layer 6 on the other side of a support sheet 7 so that the signal lines 5 and the shield layer 6 are exposed for connection with a connector. This structure may be obtained by forming the layer of signal lines 5 and the shield layer 6 on both sides of an insulating support sheet 7 or by bonding a print-circuit sheet having signal lines 5 on one side of a support sheet 7 and another support sheet coated with a grounding layer. It is also possible to bond two flexible print-circuit sheets each having signal lines and a grounding layer on one side.

FIGS. 10 and 11 are sectional views each showing another embodiment of the flexible print-circuit sheet according to the present invention. More specifically, FIG. 10 is a sectional view taken along a C–C' line in FIG. 9B and shows a structure including a conductor layer 6 for grounding only on the opposite surface of the support layer 7 with respect to the signal lines 5. FIG. 11 shows a structure including a shielding conductor layer 6 so as to surround the entirety of signal lines 5 and also a protective layer 8 coating the whole peripheral side of the conductor layer 6.

FIG. 12 is a sectional view of another embodiment of the connector according to the present invention in connection with another flexible print-circuit sheet according to the invention as illustrated in two perspective views of FIGS. 13A and 13B as viewed. from the grounding side and the signal side, respectively. The flexible print-circuit sheet includes, on one side of a support layer 7, unpatterned two conductor layers 6 and 26 including one layer 6 for grounding and the other layer 26 for connection with a maximum supply voltage Vcc (e.g., a reference voltage of 5 V) and connected with contacts 2 and 27, respectively, provided in the connector at longitudinally different positions.

Figure 15:
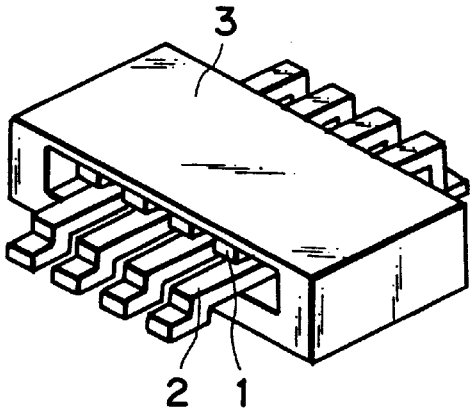
FIGS. 15–18 are respectively a perspective view of another embodiment of the connector according to the invention.

FIG. 14 is a sectional view of another embodiment of the connector in a state of connection with a flexible print-circuit sheet, and FIG. 15 is a perspective view of the connector. Similarly as the one shown in FIG. 1, the connector 50 includes a mold 3 as a housing and contacts 1 and 2 disposed on the upper side and lower side, respectively, inside the mold 3. The contacts 1 and 2 respectively contact either one of a layer of conductor lines 5 and a conductor layer 6 formed on both surfaces of a flexible print-circuit sheet 10. The contacts 1 and 2 disposed on the inner upper and lower surfaces of the mold 3 are all composed of an inwardly convex metal sheet, etc., so as to sandwich the connection part of the print-circuit sheet The electroconductive members providing the contacts 1 are extended in a direction opposite to the side of the insertion of the print-circuit sheet 10 to be soldered with a supporting board 19, and the members providing the contacts 2 are extended in a direction toward the side of insertion of the print-circuit sheet 10 to be soldered with the supporting board 19. The electroconductive members providing the contacts 1 and 2 are composed in the form of stripes disposed at a prescribed pitch.

Figure 16:
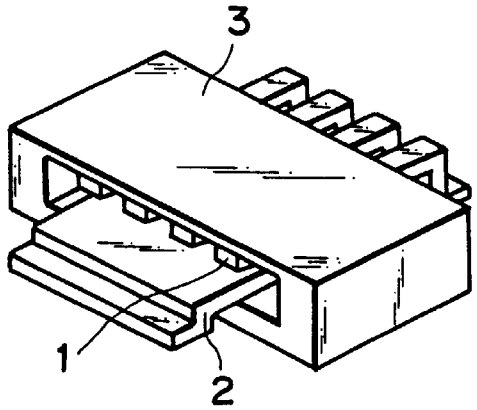

FIG. 16 is a perspective view of a modification of the connector shown in FIG. 15. The connector of FIG. 16 has a contact 2 formed over the entire width of a flat cable to be inserted and providing a uniform contact surface.

The connector of FIG. 16 may be combined with a flexible print-circuit sheet shown in FIGS. 9A and 9B so as to supply the contact 2 and the conductor layer 6 formed over the whole width with a reference potential (GND), thereby providing a stable reference potential. Further, as the physical distance between the signal lines 5 and the reference potential supply layer 6 is shortened, the fluctuation in potential of the signal lines can also be suppressed, thereby preventing a malfunction of the electric circuit apparatus and generation of radiation noises.

Figure 17:
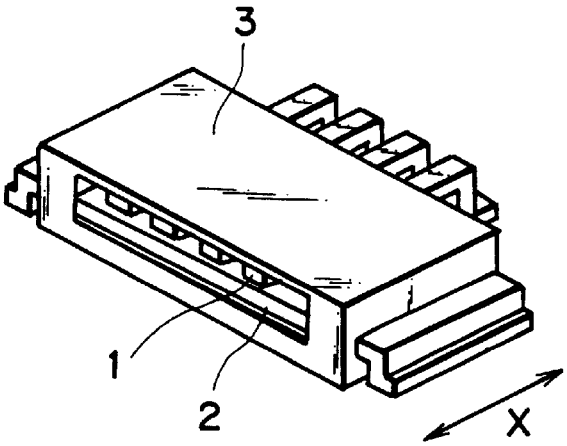

FIG. 17 is a perspective view of a modification of the connector shown in FIG. 16. The connector of FIG. 17 includes a connector 2 which is formed on the inner lower surface of a housing 3 to have a uniform contact surface over the entire width of a print-circuit sheet to be inserted and is extended in a direction of 90 degrees with respect to a direction X of the insertion of a print-circuit sheet to be soldered and fixed onto a support board (not shown). As a result, the connector can be formed in a smaller width in the direction X (the direction of insertion of a print-circuit sheet).

Figure 18:
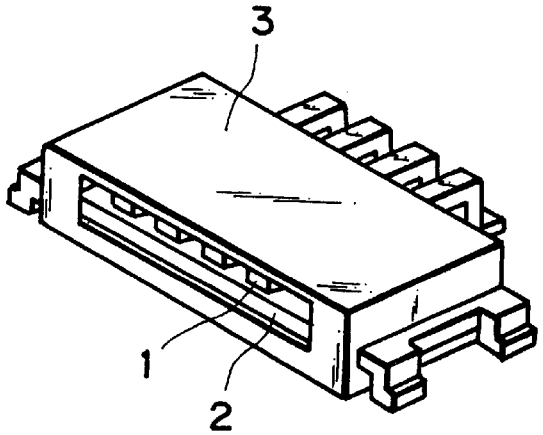

FIG. 18 is a perspective view of a further modification of the connector shown in FIG. 17. The connector of FIG. 18 includes a contact 2 formed on the inner lower surface of a housing 3 to have a uniform contact surface over the entire width of a print-circuit sheet to be inserted thereinto. The member constituting the contact 2 is extended in a direction of 90 degrees with respect to a direction of insertion of the print-circuit sheet and divided to have plural tips for connection, e.g., by soldering with a supporting board (not shown). The connector structure facilitates an operation, such as soldering, to simplify the loading process. Further, by a change in shape of connection between the supporting board and the connector, it becomes possible to provide an improved heat distribution over the connector and the print-circuit sheet at the time of re-flow loading and more specifically can minimize an adverse thermal effect, such as heat distortion.

Figure 19:
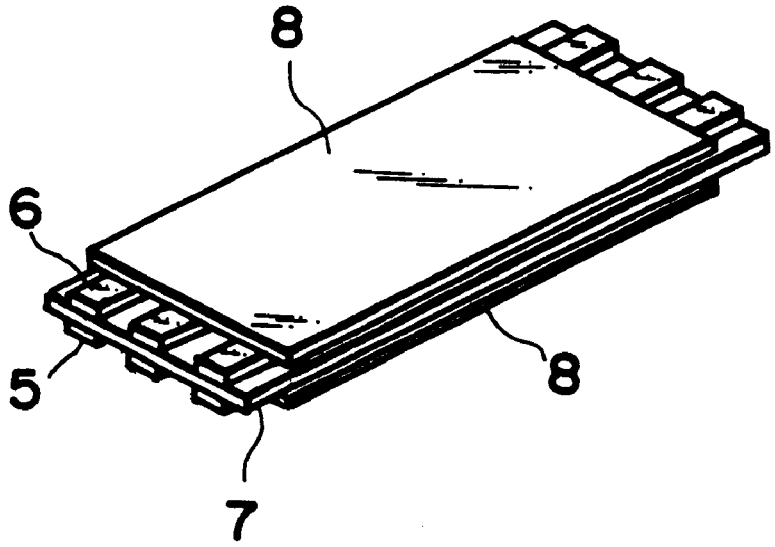
FIG. 19 is a perspective view of another flat cable according to the invention.

FIG. 19 is a perspective view of another embodiment of the flat cable (print-circuit sheet) according to the present invention, including a layer of stripe-form signal conductor lines 5 on one side of an insulating support sheet 7 and a layer of stripe conductors 6 for shielding and grounding on the opposite side. The signal conductor lines 5 and the stripe conductors 6 for shielding are both exposed at both ends for connection with a connector.

Figure 20:
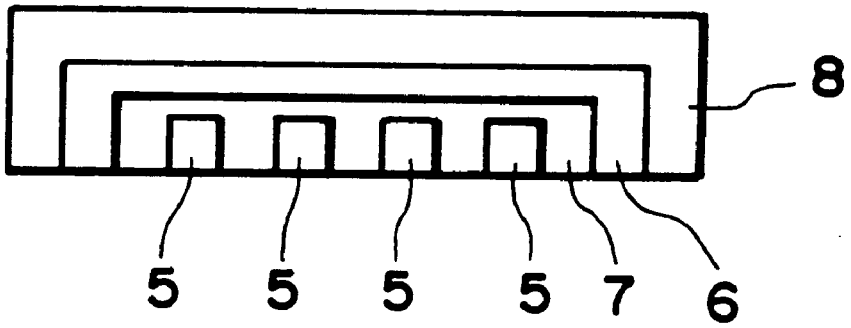
FIG. 20 is a sectional view of the connecting part of an embodiment of the flat cable according to the invention.

FIG. 20 is a transversal sectional view at a connection part of an embodiment of the flat cable, wherein signal conductor lines 5 are coated with an insulating support sheet or layer 7, formed, e.g., by wet coating, with respect to their lateral sides and upper surfaces, and the support layer 7 is further coated with a shield conductor layer 6 and an insulating protective layer. The lower surface of the conductor lines 5 and the upper surface of the shield conductor layer 6 are exposed for connection with a connector. The insulating support layer 7 may preferably comprise an insulating material having a higher dielectric constant than the protective layer 8.

As described above with reference to some embodiments, according to the flat cable and connection device (connector), it becomes possible to effect reliable electrical connection, particularly for grounding, between plural print-circuit boards with the flat cable and reduce the common-mode noise and normal-mode noise affecting the print-circuit boards and the flat cables. Further, a plurality of connectors can be mounted on a print-circuit board while the grounding is ensured, and the flat cables are reliably shielded to reduce radiation noises, thereby reducing noise-preventing means, such as three-terminal filters, ferrite beads or ferrite cores to aid a reduction in-production cost. On the other hand, a specifically provided GND line of a single core or plural cores conventionally used becomes unnecessary, so that the flat cable (particularly a flexible print-circuit sheet) can be produced in a smaller width. This also favors a reduced production cost, a simpler assemblage, and a reduction in radiation noise. These effects are particularly pronounced in apparatus requiring relatively long flat cables, such as a large size flat display having a diagonal size of 15 inches or larger. Further, a conventional flat cable has ordinarily required the grounding of a shield layer via a through-hole, etc., but this measure also becomes unnecessary according to the present invention.

Figure 21:
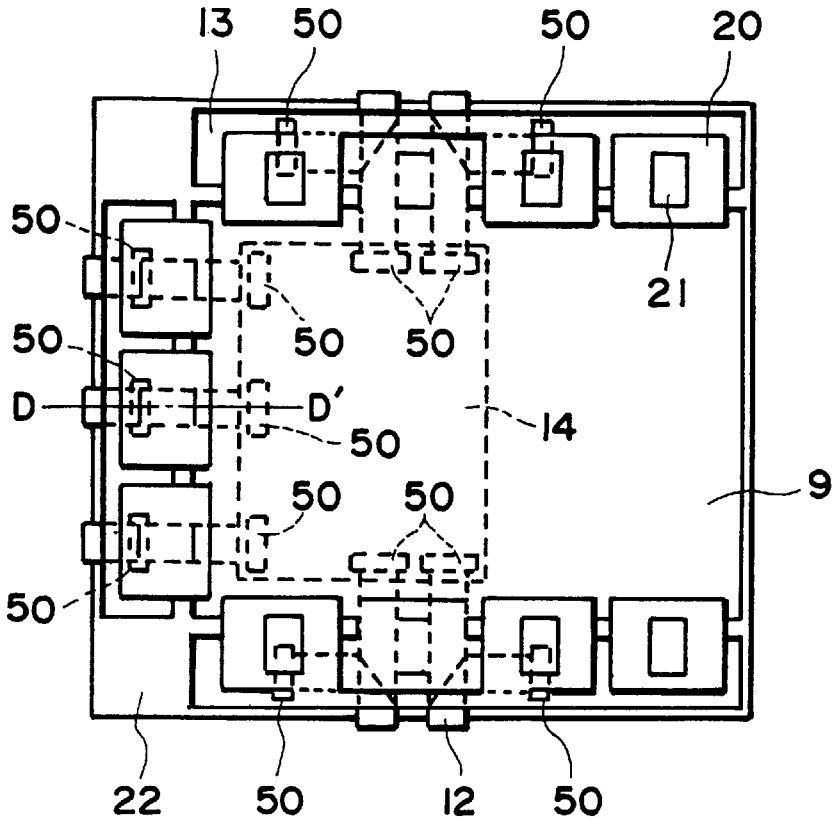
FIG. 21 is a schematic view of a liquid crystal display apparatus as an embodiment of the electric circuit apparatus according to the invention.
Figure 22:
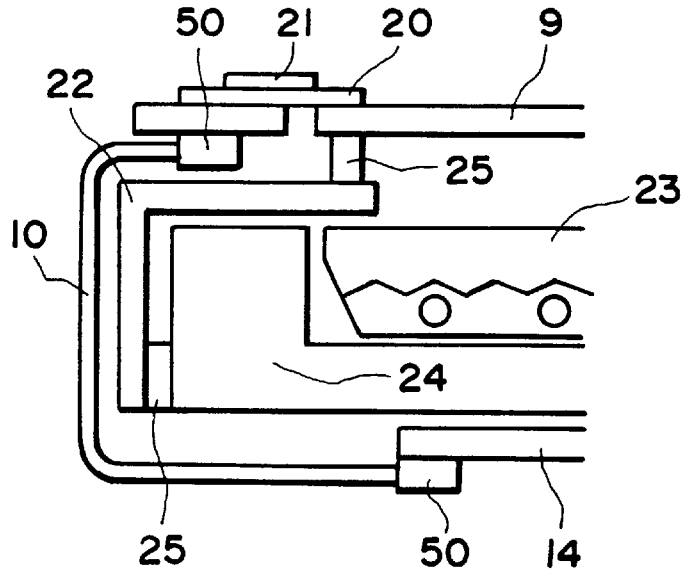
FIG. 22 is a partial sectional view taken along D–D' line in FIG. 21.

FIGS. 21 and 22 are a plan view and a partial sectional view of another liquid crystal apparatus as an embodiment of the electric circuit apparatus according to the present invention.

The liquid crystal apparatus includes a TAB film 21 loaded with a driver IC 21, a panel-fixing plate 22 to which a liquid crystal panel is fixed with an elastic adhesive 25, and a chassis 24 supporting a backlight 23 and also the panel-fixing plate 22 with an elastic adhesive 25.

In the liquid crystal apparatus, a large number of flexible print-circuit sheets 10 are used for connection between circuit boards via connectors 50 as described above.

Figure 23:
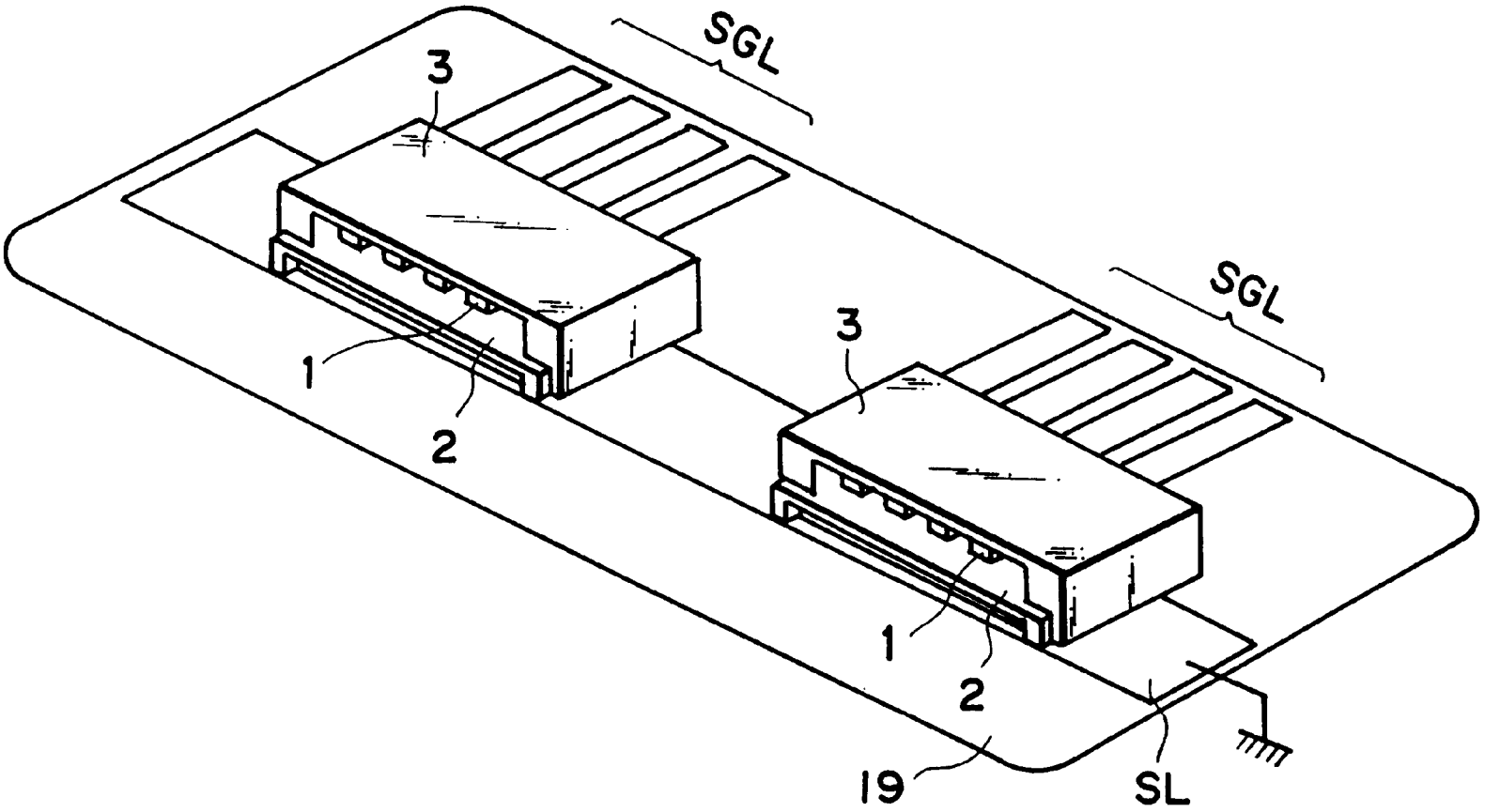
FIG. 23 is a perspective view showing a manner of loading using a connector according to the invention.
Figure 24A:
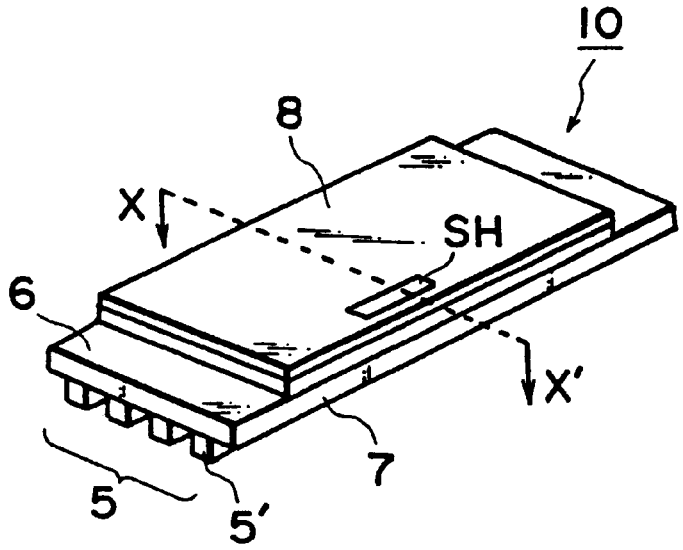
FIG. 24A PRIOR ART
FIG. 24A is a perspective view of a conventional flexible print-circuit sheet.
Figure 24B:
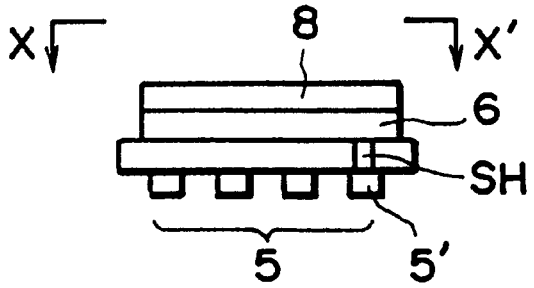
FIG. 24B PRIOR ART
FIG. 24B is a sectional view taken along an X–X' line in FIG. 24B.
Figure 24C:
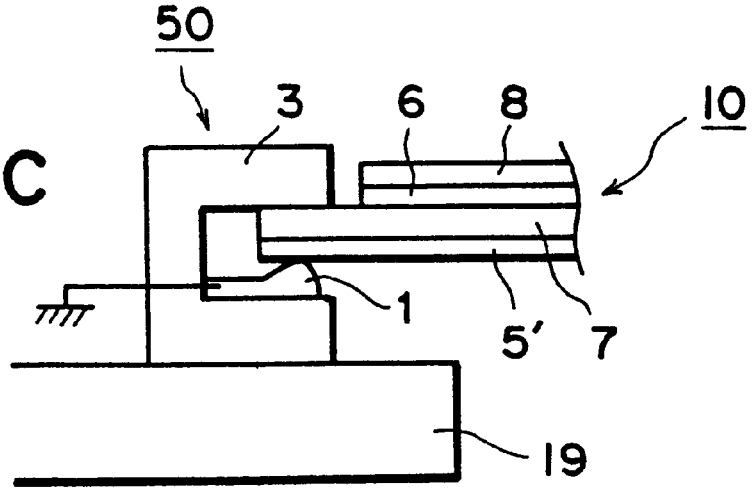
FIG. 24C PRIOR ART
FIG. 24C is a sectional view of a conventional connector in connection with the flexible print-circuit sheet.

FIG. 23 is a perspective view showing a state that two connectors 50 as illustrated with reference to FIGS. 4 and 5 are fixed onto a rigid board 19.

In the embodiment of FIG. 23, contacts 1 connected with signal lines SGL and contacts 2 connected to a single shielding line SL are housed within two housings 3. Accordingly, it is necessary to provide intersections outside the connectors, so that an unnecessary increase in loading area can be suppressed.

Next, some explanation is added to a case wherein a chiral smectic liquid crystal, as represented by a ferroelectric liquid crystal, is used in a liquid crystal panel as shown in FIG. 2 or FIGS. 21 to 22.

The electrostatic capacity C of a pixel is calculated by $$C=\epsilon_r\cdot\epsilon 0S/d,$$

wherein $\epsilon_r$: a dielectric constant of a liquid crystal, $\epsilon_0$: dielectric constant of vacuum, S: electrode area, and d: cell gap. Accordingly, if panel sizes are equivalent, the capacity of one (matrix) drive line of a chiral smectic liquid crystal panel is 2–3 times that of an STN-type and ca. 5 times that of a TFT-type liquid crystal panel principally because of a smaller cell gap d. In order to retain an identical speed of rising of drive waveform (i.e., to provide an identical CR value), the conductor resistance (including ON-resistance of a driver IC) for one line of a chiral smectic liquid crystal panel is required to be suppressed to ca. ½ to ⅓ of that of an STN-type liquid crystal panel and ca. ⅕ of that of a TFT-type liquid crystal panel.

Further, as an injection current per line is almost inversely proportional to a conductor resistance and proportional to a voltage, the injection current per line of a chiral smectic liquid crystal panel provides a peak value of 4–9 times that of an STN-type liquid crystal panel. In view of a larger panel size, the current through a driver which is proportional to a panel size provides a peak value is caused to provide a peak value exceeding 10 times that for an SNT-type liquid crystal panel.

Further, a chiral smectic liquid crystal panel having a larger panel size requires a larger print-circuit board size and a larger flat cable size, thereby being liable to result in larger induction noise and common-mode noise.

In such a liquid crystal apparatus using a chiral smectic liquid crystal, the display image qualities can be remarkably improved if the flat cable and connection device according to the present invention are adopted in a drive control system.

As described above, according to the present invention, there are provided a flat cable and a connection device allowing a high-density loading and free from fluctuation in potential and adverse effects of noises, and also an electric circuit including the flat cable and connection device in combination.

What is claimed is:

1. A connection device for connection with a flat cable having a layer of conductor or conductor lines on each of both sides of an insulating support layer, comprising:

a housing having an opening for insertion thereinto of the flat cable having mutually opposite inner surfaces; and a pair of conductor members forming contacts respectively disposed on said opposite inner surfaces of said housing for connection with the layers of conductor or conductor lines on both surfaces of the flat cable, wherein one of said pair of conductor members extends out of the housing in a lateral direction with respect to a direction of insertion of the flat cable to provide an end to be soldered onto a supporting substrate, and the other of said pair of conductor members extends out of the housing in the direction of insertion of the flat cable to provide an end to be soldered onto the supporting substrate.

2. A connection device according to claim 1, wherein each said contact comprises an inwardly convex portion of a metal member within said housing.

3. A connection device according to claim 1, wherein one of said contacts formed on said opposite inner surfaces of said housing has an almost identical width and said other contact has a smaller width, respectively, compared with the entire width of the conductor or conductor lines of the flat cable to be connected therewith.

4. A connection device according to claim 1, wherein said contacts formed on the opposite inner surfaces of the housing respectively have convexities which are opposite to each other.

5. A connection device according to claim 1, wherein one of said contacts formed on the opposite inner surfaces of said housing is connected to a reference potential supply.

6. A connection device according to claim 1, wherein said end to be soldered of said one conductor member is divided into a plurality of tips.

7. An electric circuit apparatus, comprising:

a flat cable comprising an insulating support layer and layers of a conductor or conductor lines formed on both sides, respectively, of said insulating support layer; and a connection device for connection with said flat cable, said flat cable including a connection part having a laminated structure including said insulating support layer and said layers of conductor or conductor lines disposed on both sides of said insulating support layer; and said connection device comprises a housing having an opening for insertion thereinto of the flat cable having mutually opposite inner surfaces, and a pair of conductor members forming contacts respectively disposed on the opposite inner surfaces of the housing, with said connection device being connected with said flat cable so that each contact thereof corresponds to one said conductor or conductor lines of said flat cable, wherein one of said pair of conductor members of said connection device extends out of the housing in a lateral direction with respect to a direction of insertion of said flat cable to provide an end to be soldered onto a supporting substrate, and the other of said pair of conductor members extends out of the housing in the direction of insertion of the flat cable to provide an end to be soldered onto the supporting substrate.

8. An electric circuit apparatus according to claim 7, wherein one of said pair of conductor members forming one of the contacts disposed on said opposite inner surfaces of said housing has a width substantially equal to an entire width of said conductor or conductor lines to be connected therewith and is held at a reference potential.

* * * * *

UNITED STATES PATENT AND TRADEMARK OFFICE

CERTIFICATE OF CORRECTION

PATENT NO. : 6,027,366 
APPLICATION NO. : 09/017928
DATED : February 22, 2000
INVENTOR(S) : Hideo Mori et al.

It is certified that error appears in the above-identified patent and that said Letters Patent is hereby corrected as shown below:

On Title Page Item (30)
FOREIGN APPLICATION PRIORITY DATA:

"6-048867" should read --6-148867--.

COLUMN 1:

Line 6, "Feb. 2, 1995" should read --Feb. 28, 1995--.

COLUMN 9:

Line 53, "$C=\varepsilon_r \bullet \varepsilon OS/d$," should read --$C=\varepsilon_r \bullet {}_o S/d$, --.

COLUMN 10:

Line 52, "the" (both occurrences) should read --said--.
Line 6, "the" should read --said--.

Signed and Sealed this

Fifth Day of December, 2006

JON W. DUDAS
*Director of the United States Patent and Trademark Office*